US005281755A

United States Patent [19]

Matsui et al.

[11] Patent Number: 5,281,755

[45] Date of Patent: Jan. 25, 1994

[54] APPARATUS FOR AUTOMATIC PLAYING OF A MUSICAL INSTRUMENT

[75] Inventors: Haruhiko Matsui; Tetsusau Kondo, both of Shizuoka, Japan

[73] Assignee: Kabushiki Kaisha Kawai Gakki Seisakusho, Japan

[21] Appl. No.: 951,464

[22] Filed: Sep. 25, 1992

[30] Foreign Application Priority Data

Dec. 20, 1991 [JP] Japan ..... 3-354474

[51] Int. Cl.[5] ..... G10H 1/18; G10H 7/00

[52] U.S. Cl. ..... 84/609; 84/615; 84/626

[58] Field of Search ..... 84/609-615, 84/626, 634-638, 601, 602

[56] References Cited

U.S. PATENT DOCUMENTS 5,038,660 8/1991 Watanabe ..... 84/601

*Primary Examiner*—Stanley J. Witkowski

*Attorney, Agent, or Firm*—Andrus, Sceales, Starke & Sawall

[57] ABSTRACT

Disclosed is an apparatus for automatic playing of a musical instrument. This apparatus has holding means for holding pedal play information that is included in play information that is read from storage means. During a fast forward or a fast reverse operation, the apparatus for automatic playing of a musical instrument holds in the holding means the most recent history of pedal play information, and when the operation is released, and in advance of the execution of play information for keys, the apparatus drives a pedal terminal in consonance with the retained pedal play information, and then reproduces music.

10 Claims, 6 Drawing Sheets

APPARATUS FOR AUTOMATIC PLAYING OF A MUSICAL INSTRUMENT

BACKGROUND OF THE INVENTION

1. Field of the Invention

The present invention relates to an apparatus for automatic playing of a musical instrument, an apparatus that plays music on demand by using prerecorded play information, which is held in a storage device, to control the performance of a musical instrument.

Apparatuses for automatic playing of musical instruments, which are attached to, for example, pianos, are in current, practical use. To produce music, these apparatuses use prerecorded play information to operate drive mechanisms that manipulate keyboards or pedals.

In addition to normal playing functions, presently employed playing apparatuses ordinarily have a function for accelerating musical progression (hereafter referred to as "fast forward"), and another function for accelerating musical retrogradation (hereafter referred to as "fast reverse").

As fast forward and fast reverse differ drastically from normal playing functions, and possess the potential to adversely affect the quality of music, reproduction fidelity demands that special care be taken to ensure that melodic content is not degraded when fast forward and fast reverse are used.

2. Description of the Related Art

A conventional apparatus for automatic playing of a musical instrument incorporates a storage device, e.g., a floppy disk, that holds play information, including, for example, key numbers, key depression force and time information. When the apparatus receives a signal to begin playing, via, for example, an operation panel, it reads play information from the storage device and uses this information in its operation of the musical instrument.

More specifically, play information constituting event information groups is previously stored in a storage device. As shown by the example in FIG. 4, one event information group consists of an identification symbol, a key number, key depression force, and time information.

When playing is initiated, one event information group of the play information is read from the storage device, and the included time information is examined. When the time information corresponds to an execution timing (time) for the read-out event information, procedures for this event are performed, i.e., keys are depressed or released.

After the procedures for one event information group have been completed, the next event information group is read from the storage device, and the described process is repeated. Music is produced by repeatedly reading and processing event information groups.

The execution time for an event information group is determined as follows: A time count, which is held by a time counter that counts clock cycles, is compared with the time information in the read-out event information group, and when they correspond, it is assumed that the procedures for the event should be performed.

Besides the above described normal playing functions, a conventional apparatus for automatic playing of a musical instrument has fast forward and fast reverse functions. There are two well-known methods for performing fast forward or fast reverse that are used when either the fast forward function or the fast reverse function is selected.

To perform fast forward or fast reverse using the first method, the speed of the clock that governs the operation of the time counter is increased to greater than that for normal reproduction. The performance of the time counter is thereby accelerated, and the execution time for the procedures of the current event information group is advanced.

When fast forward or fast reverse is performed using the second method, the clock speed is not increased and the performance of the time counter is not accelerated. Instead, to speed up performance and to determine an advanced execution time, predetermined multiples of the time count held by the time counter are compared with the time information of the most recently read event information group.

As an automatic playing apparatus that includes a drive mechanism cannot adequately cope with high speed execution, and as the directional order of ON events and succeeding OFF events is inverted when fast reverse is performed, such an automatic playing apparatus usually does not activate operation terminals when either fast forward or fast reverse is selected.

More specifically, when fast forward or fast reverse is selected, all operation terminals, which include a keyboard terminal and a pedal terminal that are being driven, are set to OFF, and fast forward or fast reverse is immediately thereafter begun.

After the fast forward or the fast reverse has been completed, and until the next pedal play information is processed, the pedal terminal is maintained in the OFF state, as it was set when the fast forward or the fast reverse was selected.

Suppose, then, that the first pedal play information to be processed after playing is resumed is OFF event information. Although the state of an event must be ON during the period between the resumption of normal play and the point at which pedal play information is processed, as the pedal terminal has not been activated the actual event state during this period is OFF, and music quality is thereby significantly impaired.

The shortcomings associated with fast forward and fast reverse operations will be explained in more detail referring to FIG. 5 (fast forward phase) and FIG. 6 (fast reverse phase).

FIG. 5 is a diagram for explaining a fast forward operation. Pedal play information is represented by the identifiers e1 to e8. The several intervals between the identifiers e1 to e8 are occupied by keyboard play information, but such information is not shown here.

In the interval between e1 and e2 a pedal terminal is being driven (ON period), and in the interval between e2 and e3 a pedal terminal is not activated (OFF period). The succeeding ON/OFF states are as shown in the lower level in the diagram.

If fast forward is begun at point A and is released at point B, music is immediately reproduced at point B.

Although the pedal terminal should be activated in the interval between e5 and e6, as shown in FIG. 5, because of the fast forward selection, as described above, the pedal terminal is actually in the OFF state, and music reproduced during this interval is significantly impaired.

FIG. 6 is a diagram for explaining a fast reverse operation. Pedal play information is represented by the identifiers e11 to e18. The several intervals between the identifiers e11 to e18 are occupied by keyboard play information, but such information is not shown here.

In the interval between e11 and e12 the pedal terminal is being driven (ON period), and in the interval between e12 and e13 the pedal terminal is not activated (OFF period). The following ON/OFF states are as shown in the lower level in the diagram.

If normal playing is started at point C and fast reverse is selected at point D, to perform fast reverse, play information is read out toward point E at faster than the normal playing speed. Then, when fast reverse is released at point E, music is immediately reproduced there.

Although the pedal terminal should be activated in the interval between e11 and e12, as shown in FIG. 6, because of the fast reverse selection, as described above, the pedal terminal is actually in the OFF state, and music reproduced during this interval is significantly impaired.

When a pedal terminal is, for example, a damper pedal of a piano, the period during which music is degraded spans several seconds, sometimes several tens of seconds.

SUMMARY OF THE INVENTION

To overcome the shortcoming that an operation terminal, particularly a pedal terminal, will not be set as it should when fast forward or fast reverse is released, and that reproduced music will therefore be much deteriorated, it is an object of the present invention to provide an apparatus, for automatic playing of a musical instrument, that can perform normal automatic playing without impairing the quality of reproduced music, even immediately after fast forward or fast reverse is released.

To achieve this object, an apparatus for automatic playing of a musical instrument according to the present invention, an apparatus that has storage means for storing play information, which at the least includes keyboard play information and pedal play information, and that sequentially reads the play information from the storage means and uses the play information to operate a keyboard terminal and a pedal terminal and thus plays music, comprises: instructing means for instructing fast forward of music; fast forward means for stopping all operation terminals when the fast forward is instructed by the instructing means, and for merely reading the play information from the storage means; holding means for holding, as the latest pedal play information, pedal play information of the play information most recently read from the storage means during the fast forward by the fast forward means; and control means for activating, when the fast forward by the fast forward means is released, a pedal terminal in consonance with the latest pedal play information that is held in the holding means and then reproducing music.

Further, to achieve the above described object, an apparatus for automatic playing of a musical instrument according to the present invention, an apparatus that has storage means for storing play information, which at the least includes keyboard play information and pedal play information, and that sequentially reads the play information from the storage means and uses the play information to operate a keyboard terminal and a pedal terminal and thus plays music, comprises: instructing means for instructing fast reverse of music; fast reverse means for stopping all operation terminals when the fast reverse is instructed by the instructing means, and for merely reading the play information from the storage means; holding means for holding, as the latest pedal play information, pedal play information of the play information most recently read from the storage means during the fast reverse by the fast reverse means; and control means for activating, when the fast reverse by the fast reverse means is released, a pedal terminal in consonance with the latest pedal play information that is held in the holding means and then reproducing music.

According to the present invention, the last history of pedal play information acquired during a fast forward or a fast reverse operation is held in the holding means, and when the fast forward or the fast reverse is released, the pedal terminal is activated, in consonance with the contents of the holding means, and normal playing is resumed. Music can therefore be reproduced without any deterioration.

DETAILED DESCRIPTION OF THE PREFERRED EMBODIMENT

The preferred embodiment of the present invention will now be described in detail while referring to the accompanying drawings.

Figure 1:
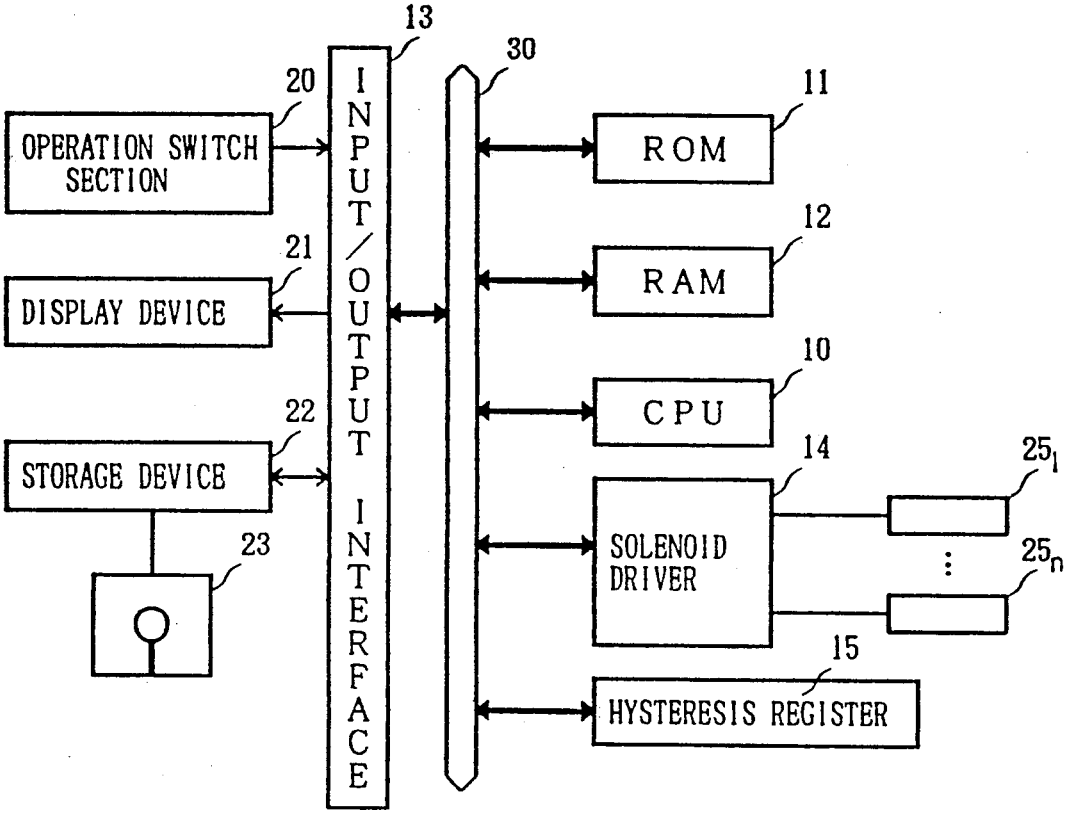
FIG. 1 is a schematic block diagram illustrating the arrangement of one embodiment according to the present invention.

FIG. 1 is a schematic block diagram illustrating the general structure of an apparatus, for automatic playing of a musical instrument, wherein the present invention is applied.

A Central Processing Unit (CPU) 10 controls the individual sections of the automatic playing apparatus in consonance with a control program that is stored in a Read Only Memory (ROM) 11.

Besides the control program, various data constants to be used by the CPU 10 are stored in the ROM 11. The ROM 11 is accessed by the CPU 10 via a system bus 30.

In a Random Access Memory (RAM) 12 are defined a work area for the CPU 10 and various registers and flags to control the apparatus for automatic playing of a musical instrument. The RAM 12, as well as the ROM 11, is accessed by the CPU 10 via the system bus 30.

An input/output interface 13 is connected to the system bus 30, and an operation switch section 20, a display device 21 and a storage device 22 are connected to the input/output interface 13.

The operation switch section 20 includes various switches, such as a start switch for instructing the start for automatic playing, a fast forward switch for instructing fast forward operation, and a fast reverse switch for instructing fast reverse operation (none of them shown). The ON/OFF switch states of the operation switch section 20 are detected by a scan circuit (not shown), and are sent via the input/output interface 13 to the CPU 10. The ON/OFF switch state information is stored in a predetermined area in the RAM 12.

The display device 21 is, for example, an LCD (liquid crystal display), and is used to display messages and the condition of the automatic playing apparatus. The display device 21 is controlled by information that is sent from the CPU 10 via the input/output interface 13.

The storage device 22, in this embodiment, is a floppy disk unit that employs a floppy disk 23 as a recording medium. Play information is recorded on the floppy disk 23.

With the above described structure, the operation of this embodiment will now be explained.

Figure 4:
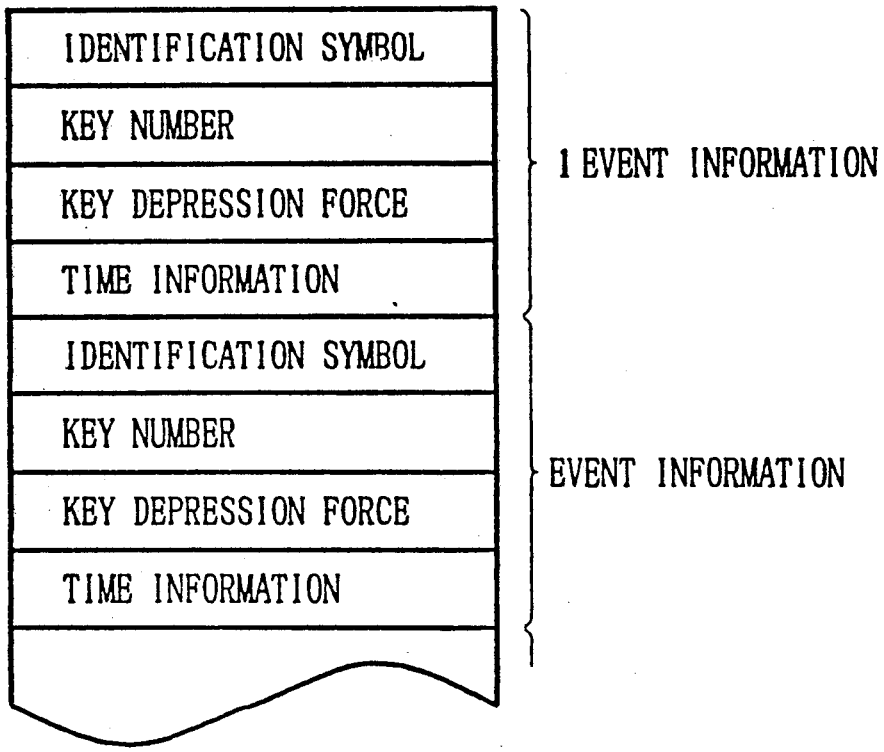
FIG. 4 is a diagram illustrating an example of a play information format according to the present invention.
Figure 5:
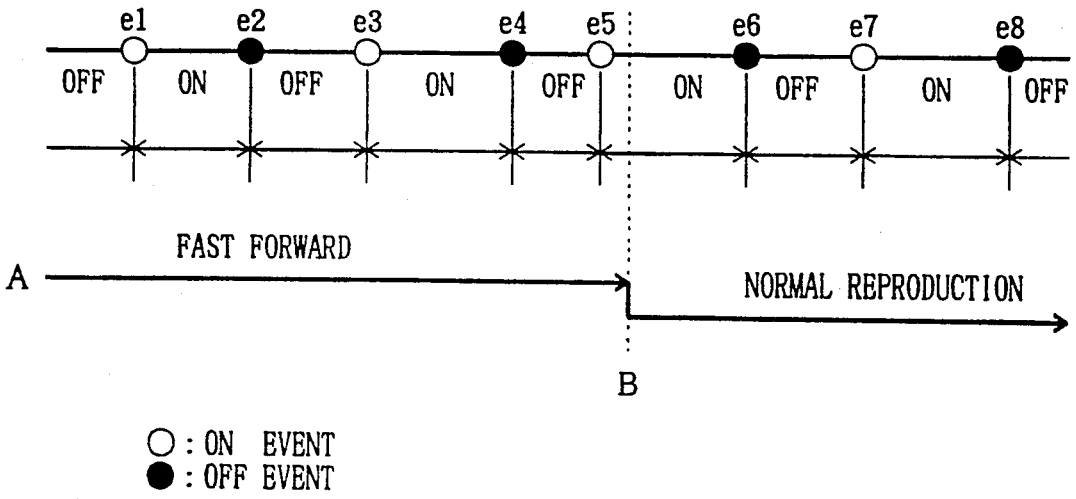
FIG. 5 is a diagram for explaining a conventional fast forward operation.
Figure 6:
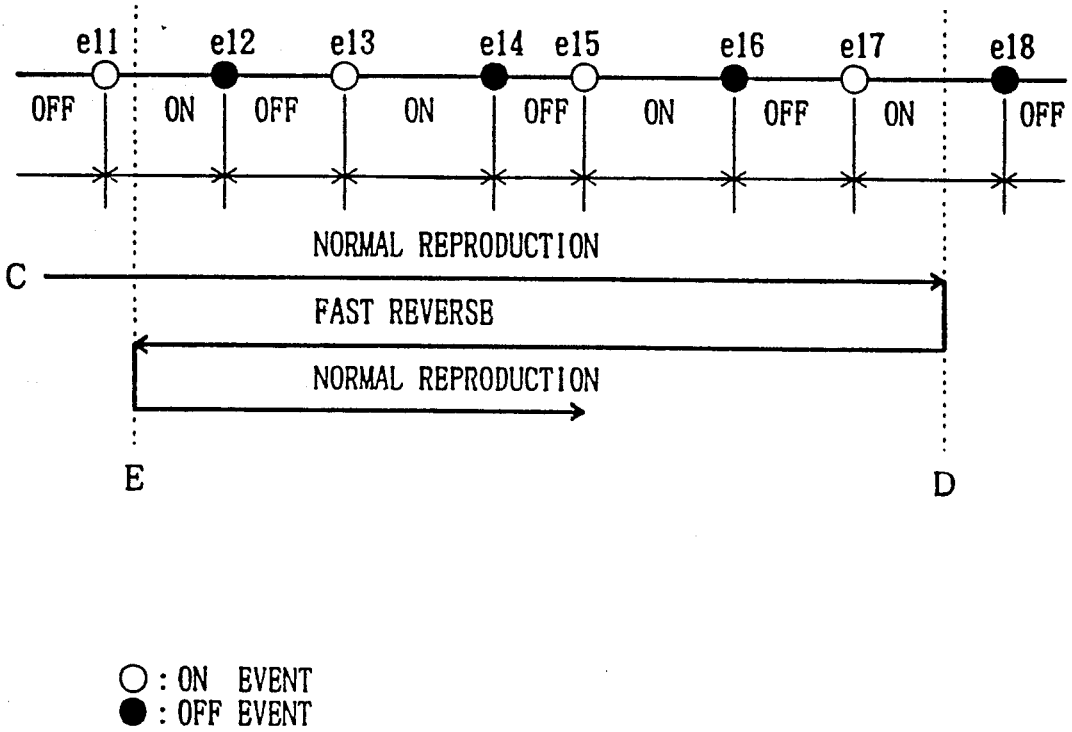
FIG. 6 is a diagram for explaining a conventional fast reverse operation.

As shown in FIG. 4, event information groups constitute play information. Each event information group consists of an identification symbol, a key number, key depression force, and time information. The identification symbol identifies the type of event information. The identification symbol is used, for example, to determine whether the event information is play information for a keyboard terminal, or is play information for a pedal terminal, and to indicate whether the event information is data for an ON event or for an OFF event.

A key number shows the number of a key where an event should be performed. Key depression force determines the force or the speed of key depression/release at the time of an ON event or an OFF event. Time information is data that indicates the time when the event information should be processed. When such time information corresponds to the value of a time counter (not shown), an event in consonance with the event information that is currently being processed will be performed.

Play information, after it has been read from the floppy disk 23 that is employed by the storage device 22, is sent to the CPU 10 via the input/output interface 13 to be used for automatically playing a musical instrument.

A solenoid driver 14 drives solenoids $25_1$ to $25_n$, one of which is provided for each key. These solenoids $25_1$ to $25_n$ are coupled to correspondingly numbered keys. When the solenoid driver 14 is activated by the CPU 10, the solenoids $25_1$ to $25_n$ are driven accordingly, and thus perform a key depression function by depressing (or affecting) their correspondingly numbered keys.

A key release function is accomplished when the solenoid driver 14 is stopped by the CPU 10 and the solenoids $25_1$ to $25_n$ are inactivated.

A hysteresis register 15 is a holding means, a primary feature of the present invention. The hysteresis register 15 is used to hold play information for a pedal terminal. The contents of the hysteresis register 15 are updated whenever the automatic play information that is read from the storage device 22 is pedal play information. The hysteresis register 15 therefore always holds the latest (most recently processed) pedal play information.

The hysteresis register 15 in this embodiment is established as an independent register; however, the hysteresis register 15 may be provided in the RAM 12.

Figure 2:
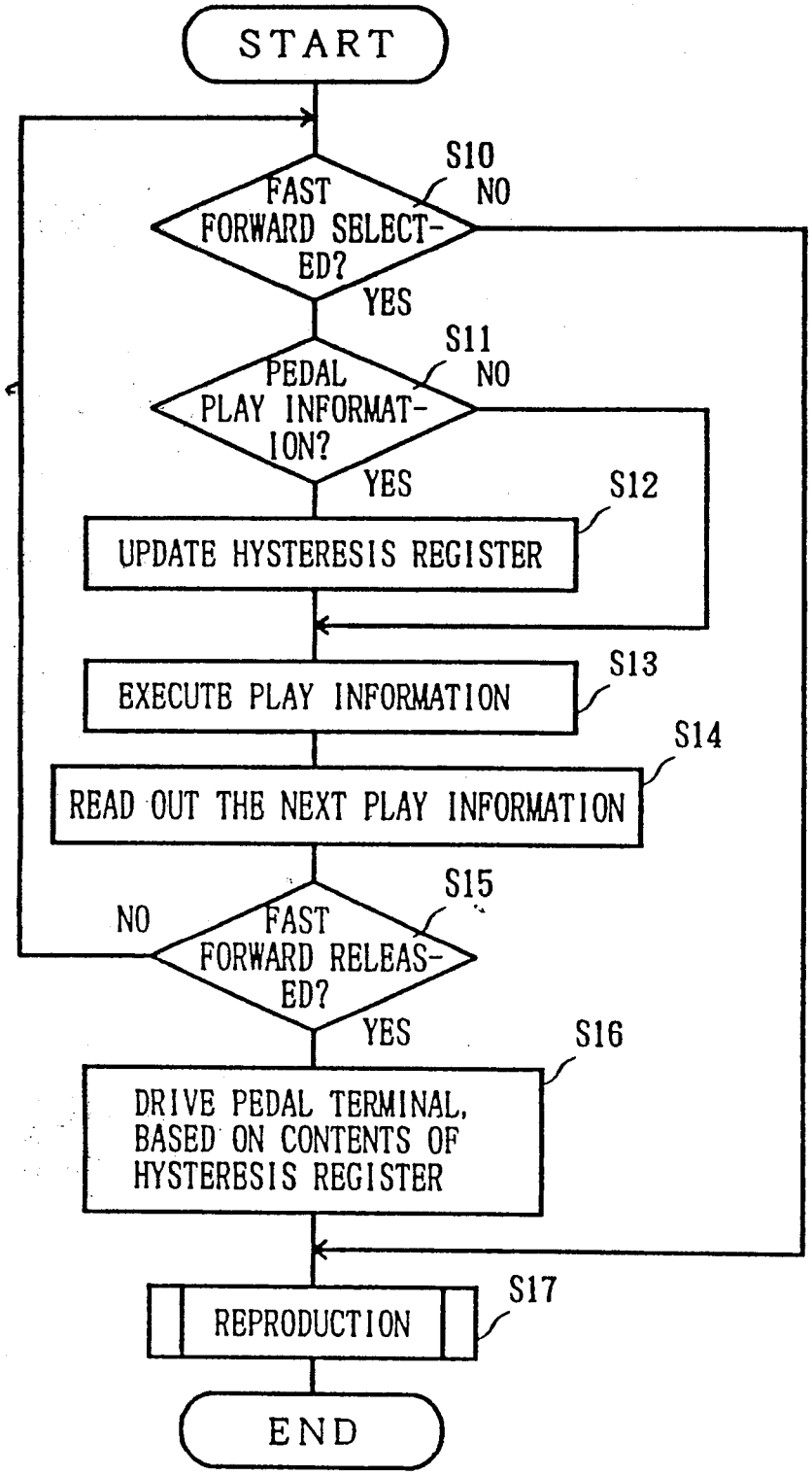
FIG. 2 is a flowchart showing the operation of the embodiment according to the present invention when fast forward is selected.

The fast forward operation will now be explained while referring to a flowchart shown in FIG. 2.

This routine is performed when it is time to execute an event information group that has been read from the storage device 22.

First, a check is made to determine whether fast forward has been selected (step S10). As long as the fast forward switch in the operation switch section 20 is depressed, such information is stored in a predetermined area in the RAM 12. Whether or not fast forward has been selected is determined by examining that information.

When fast forward has not been selected, program control branches to step S17 to perform a normal reproduction process. More specifically, the solenoid driver 14 is operated by the CPU 10 in consonance with event information, and using a specified key depression force, the solenoid driver 14 depresses or releases a key, as designated by a key number, of an operation terminal defined by the identification symbol in the relevant event information.

If, in step S10, fast forward is found to have been selected, a check is performed to determine whether the event information to be executed is pedal play information (step S11). This check is also made by examining the identification symbol in the relevant event information.

When the event information is found to be pedal play information, the hysteresis register 15 is updated (step S12). That is, the contents of the hysteresis register 15 are replaced with the latest pedal play information. If the event information is not pedal play information, the process in step S12 is omitted.

Then, play information is executed (step S13). During this process, an address pointer for reading out play information is updated in order to return to normal playing after fast reverse has been released, and elapsed time is totaled to display performance duration. Since this routine is performed during a fast forward operation, however, no operation terminal is actually driven.

The next play information is then read from the storage device 22 for the next repetition of the execution process (step S14).

Subsequently, a check is performed to determine whether fast forward has been released (step S15). More specifically, while the fast forward switch of the operation switch section 20 is depressed, such information is stored in a predetermined area in the RAM 12, and whether or not fast forward has been released is determined by examining the stored information.

When fast forward has not been released, program control returns to step S10 and the above described processes are repeated.

If fast forward is found to have been released, a pedal terminal is operated in consonance with the pedal play information that is stored in the hysteresis register 15 (step S16). As a result, the state of the pedal terminal immediately before the fast forward switch was released can be obtained.

During a music reproduction process (step S17), keys are depressed and released in the manner described above, so that music, including musical tones that are produced via the pedal terminal, will be performed. Accordingly, the quality of music is not adversely affected.

Figure 3:
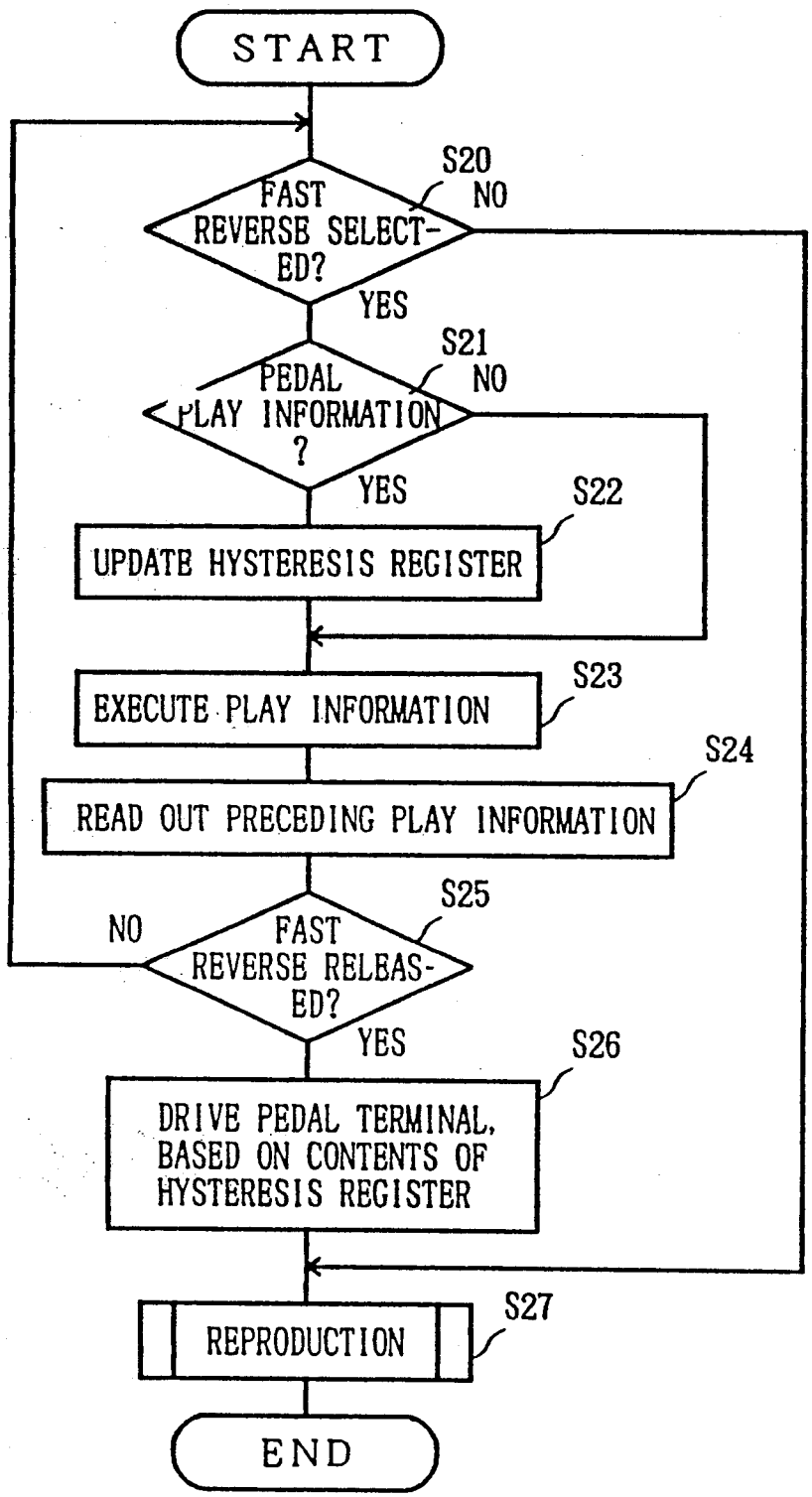
FIG. 3 is a flowchart showing the operation of the embodiment according to the present invention when fast reverse is selected.

The fast reverse operation will now be explained while referring to a flowchart shown in FIG. 3. It should be noted here that fast reverse handles event information stored in the hysteresis register 15 differently from fast forward. That is, since the order of ON and OFF events during a fast reverse is the inverse of this order during the fast forward, the latest history of pedal play information must be inverted either before it is stored in the hysteresis register 15, or before it is used to operate a pedal terminal.

This routine is performed when it is time to execute the event information that has been read from the storage device 22.

First, a check is made to determine whether fast reverse has been selected (step S20). As long as the fast reverse switch in the operation switch section 20 is depressed, such information is stored in a predetermined area in the RAM 12. Whether or not fast reverse has been selected is determined by examining that information.

When fast reverse has not been selected, program control branches to step S27 to perform a normal reproduction process. More specifically, the solenoid driver 14 is operated by the CPU 10 in consonance with event information, and using a specified key depression force, the solenoid driver 14 depresses or releases a key, as designated by a key number, of an operation terminal defined by an identification symbol in the relevant event information.

If, in step S20, fast reverse is found to have been selected, a check is performed to determine whether the event information to be executed is pedal play information (step S21). This check is also made by examining the identification symbol in the relevant event information.

When the event information is found to be pedal play information, the hysteresis register 15 is updated (step S22). That is, the contents of the hysteresis register 15 are replaced with the latest pedal play information. If the event information is not pedal play information, the process in step S22 is omitted.

Then, play information is executed (step S23). During this process, an address pointer for reading out play information is updated (set to an earlier address) in order to return to normal playing after fast reverse has been released, and elapsed time is totaled (reduced) to display performance duration. Since this routine is performed during a fast reverse operation, however, no operation terminal is actually driven.

The next play information is then read from the storage device 22 for the next repetition of the execution process (step S24).

Subsequently, a check is performed to determine whether fast reverse has been released (step S25). More specifically, while the fast reverse switch of the operation switch section 20 is depressed, such information is stored in a predetermined area in the RAM 12, and whether or not fast reverse has been released is determined by examining the stored information.

When fast reverse has not been released, program control returns to step S20 and the above described processes are repeated.

If fast reverse is found to have been released, a pedal terminal is operated in consonance with the pedal play information that is stored in the hysteresis register 15 (step S26). If, in step S22, the latest history of pedal play information held in the hysteresis register 15 is not inverted when it is stored, this information is inverted before it is used to activate a pedal terminal. As a result, the state of the pedal terminal immediately before the fast reverse switch was released can be obtained.

During a music reproduction process (step S27), keys are depressed and released in the manner described above, so that music, including musical tones that are produced via the pedal terminal, will be performed. Accordingly, the quality of music is not adversely affected.

As described above, an automatic playing apparatus according to the present invention, unlike a conventional apparatus, suitably sets a pedal terminal for the resumption of normal playing immediately after a fast forward operation or a fast reverse operation is released. It is therefore possible to provide an apparatus, for automatic playing of a musical instrument, that can resume normal automatic playing without corrupting the quality of the reproduced music.

What is claimed is:

1. An apparatus for automatic playing of a musical instrument, an apparatus that has storage means for storing play information, which at the least includes keyboard play information and pedal play information, and that sequentially reads said play information from said storage means and uses said play information to operate a keyboard terminal and a pedal terminal and thus plays music, comprising:

instructing means for instructing fast forward of music;

fast forward means for stopping all operation terminals when said fast forward is instructed by said instructing means, and for merely reading said play information from said storage means;

holding means for holding, as the latest pedal play information, pedal play information of said play information most recently read from said storage means during said fast forward by said fast forward means; and control means for activating, when said fast forward by said fast forward means is released, a pedal terminal in consonance with said latest pedal play information that is held in said holding means, and then reproducing music.

2. An apparatus according to claim 1, wherein said play information is constituted by event information groups, and each of said event information groups is comprised of an identification symbol, a key number, key depression force, and time information.

3. An apparatus according to claim 1, wherein a floppy disk is employed as said storage means, and said play information is recorded on said floppy disk.

4. An apparatus according to claim 1, wherein a hysteresis register is employed as said holding means, and play information for said pedal terminal is held in said hysteresis register.

5. An apparatus according to claim 2, wherein said pedal play information is identified by said identification symbol in said event information groups.

6. An apparatus for automatic playing of a musical instrument, an apparatus that has storage means for storing play information, which at the least includes keyboard play information and pedal play information, and that sequentially reads said play information from said storage means and uses said play information to operate a keyboard terminal and a pedal terminal and thus plays music, comprising:

instructing means for instructing fast reverse of music;

fast reverse means for stopping all operation terminals when said fast reverse is instructed by said instructing means, and for merely reading said play information from said storage means;

holding means for holding, as the latest pedal play information, during said fast reverse by said fast reverse means, pedal play information of said play information most recently read from said storage means; and control means for activating, when said fast reverse by said fast reverse means is released, a pedal terminal in consonance with said latest pedal play information that is held in said holding means, and then reproducing music.

7. An apparatus according to claim 6, wherein said play information is constituted by event information groups, and each of said event information groups is comprised of an identification symbol, a key number, key depression force, and time information.

8. An apparatus according to claim 6, wherein a floppy disk is employed as said storage means, and said play information is recorded on said floppy disk.

9. An apparatus according to claim 6, wherein a hysteresis register is employed as said holding means, and play information for said pedal terminal is held in said hysteresis register.

10. An apparatus according to claim 7, wherein said pedal play information is identified by said identification symbol in said event information groups.

* * * * *